United States Patent [19]

Wiley et al.

[11] Patent Number: 4,595,188

[45] Date of Patent: Jun. 17, 1986

[54] ENVELOPE FEEDING SYSTEM AND SPEED CONTROL FOR MAIL SORTING MACHINES

[75] Inventors: David Wiley, Shawnee; Roy A. Akers, Olathe, both of Kans.

[73] Assignee: Bell & Howell Company, Chicago, Ill.

[21] Appl. No.: 671,598

[22] Filed: Nov. 15, 1984

[51] Int. Cl.[4] ..... B65H 1/02; B65H 3/12

[52] U.S. Cl. ..... 271/4; 271/30.1; 271/31.1; 271/153

[58] Field of Search ..... 271/4, 3.1, 150, 149, 271/152, 153, 154, 155, 30.1, 31, 129, 130, 903; 198/454; 414/103

[56] References Cited

U.S. PATENT DOCUMENTS

| | | | |
|---|---|---|---|
| 3,347,348 | 10/1967 | Flint et al. | 198/454 |
| 3,598,400 | 8/1971 | Nelson | 271/150 |
| 3,647,203 | 3/1972 | DeHart | 271/903 X |
| 3,690,474 | 9/1972 | Klappenecker | 414/103 |
| 3,817,516 | 6/1974 | Lazzarotti et al. | 271/150 |
| 3,931,880 | 1/1976 | Ayer | 271/150 X |
| 3,945,633 | 3/1976 | Knopp | 271/150 X |
| 3,966,193 | 6/1976 | Storace et al. | 271/150 |
| 3,981,493 | 9/1976 | Klappenecker et al. | 271/10 |
| 4,275,870 | 6/1981 | Akers | 271/5 |
| 4,299,379 | 11/1981 | Preston et al. | 271/149 X |
| 4,302,000 | 11/1981 | Frank | 271/153 X |
| 4,328,962 | 5/1982 | Akers | 271/150 X |

*Primary Examiner*—Bruce H. Stoner, Jr.
*Assistant Examiner*—Lawrence J. Goffney, Jr.
*Attorney, Agent, or Firm*—Kokjer, Kircher, Bradley, Wharton, Bowman & Johnson

[57] ABSTRACT

A speed control system for an envelope feeding mechanism used to feed envelopes to a pickoff device in a high speed mail sorting machine. The feeding mechanism includes a pair of toothed belts which convey the envelopes along an inclined surface. The side edges of the envelopes are received by a third toothed belt which is driven at an elevated position along a side panel. The belts are driven by a multiple speed electric motor controlled by electronic circuitry which automatically decrements or increments the motor speed if the envelopes are bunched together too tightly or too loosely. If the speed is decremented and the envelopes are still tightly bunched, the drive motor is stopped by a shutoff circuit which operates independently of the speed control circuit.

27 Claims, 8 Drawing Figures

ENVELOPE FEEDING SYSTEM AND SPEED CONTROL FOR MAIL SORTING MACHINES

BACKGROUND OF THE INVENTION

This invention relates generally to high speed mail sorting equipment and deals more particularly with an improved method and apparatus for automatically controlling the speed at which envelopes are conveyed in the magazine section of a mail sorting machine.

In order to efficiently sort the large volumes of mail that are sent and received each day by various businesses, institutions, governmental units and other entitles that handle large amounts of mail, various types of mail sorting machines have been proposed. One type of high speed mail sorter that has been successful is shown in by U.S. Pat. No. 4,275,875 which issued to Roy Akers on June 30, 1981 and which is owned by the assignee of the present application. In this type of machine, the envelopes which are to be sorted are loaded on a magazine section of the machine with the envelopes situated side to side on edge. An envelope feeding mechanism delivers the envelope supply to a pickoff station at which the envelopes are picked off one at a time from the envelope supply by vacuum belts or another type of pickoff device. The envelopes are thereafter handled individually, and each envelope is conveyed past a reading station at which its zip code or another code imprinted on the envelope is read, either by a human operator or by a code reading device. Envelopes which have the same or a similar code are thereafter directed into the same storage bins by the mail sorting equipment.

Although this type of machine has been favorably received and has performed well for the most part, it has not been wholly free of problems. One of the most difficult problems has been to assure that the envelopes are repeatedly picked off one at a time from the envelope supply in the magazine section of the machine. In order for the vacuum belts to properly separate the individual envelopes from the envelope supply, the feeding system must be able to accommodate different types, sizes and thicknesses of envelopes. For example, if relatively thin envelopes are being sorted, there is a tendency for the envelopes to bunch tightly together and thus adhere to one another at the pickoff station. This tightly bunched condition of the envelopes often results in double picking and other mispicking problems. Conversely, if the envelopes are not held together tightly enough, as tends to occur when thick envelopes are being handled, similar picking problems arise and the through put of the machine also suffers.

Various types of envelope feeding mechanisms have been proposed for delivery of the envelopes to the pickoff device, including chains, augers, belts, push blocks and other conveyor systems. In order to permit the feeding mechanism to accommodate different mail thicknesses, a speed control knob has been provided so that the operator can slow the envelope feeder down when handling thin envelopes and speed it up when handling thicker mail. However, it is necessary for the human operator of the machine to closely observe the feeding operation and to manually adjust the speed control knob according to the mail that is being handled at each particular time. Due to human error and inattention, it is common for the control knob to be ignored so that the feeding mechanism generally operates at a constant speed even when the mail thickness changes. Consequently, this type of arrangement does not eliminate the double picking problems and other inefficiencies previously mentioned.

SUMMARY OF THE INVENTION

The present invention is directed to an improved envelope feeding mechanism and to an electronic control system which automatically assures that envelopes are fed to the pickoff station at the proper rate. In accordance with the invention, the magazine section of a high speed mail sorting machine is equipped with a pair of toothed belts for conveying the envelopes in the magazine. The belts travel along a floor panel which is inclined from side to side to maintain the side edges of the envelopes against an inclined side panel. The bottom edges of the envelopes are received in grooves formed between the teeth of the underlying belts so that advancement of the belts advances the envelope supply toward the pickoff station at the end of the magazine.

A third belt travels along the side panel and is elevated with respect to the other two belts. The elevated belt is also a toothed belt which receives the side edges of the envelopes in grooves formed between the teeth. This helps to convey the envelopes and maintains each envelope in an upright posture as it is fed toward the vacuum belts of the pickoff device. All three belts are driven at the same speed by a common drive system so that the envelopes do not beocme skewed or otherwise disoriented as they approach the vacuum belts.

The speed at which the tooth belts are driven is controlled electronically to assure a proper envelope feeding rate at all times. A switch which projects between the vacuum belts is depressed when mail is present at the pickoff station and is released when the pickoff station is vacant. An electronic up/down counter decrements its count state when the switch is depressed and increments the count state when the switch is released. If the count state reaches the minimum or maximum, indicating that the envelopes are being fed too fast or too slow, the counter provides an output signal which is used to slow down or speed up the multiple speed electric motor which drives the toothed belts. Consequently, the envelope feeding device is automatically slowed down when the envelopes become too tightly bunched and is automatically speeded up when the envelopes are too loose in the magazine section of the mail sorting machine.

It is an important feature of the invention that the counter decrements the count state faster than it is incremented. This results in a relatively fast decrease in the speed of the drive belts when the envelopes are tightly bunched. It is less important to quickly speed up the feeding mechanism when the envelopes are arranged too loosely, so the speed is increased at less frequent intervals in this situation.

The electronic motor control system also includes a circuit which operates to deactivate the drive motor independently of the speed control circuit. If the speed of the feeding mechanism is decremented and the switch remains depressed for an additional time interval, indicating that the envelopes are still tightly bunched at the pickoff station, the drive motor is deactivated to allow the envelope picker to eliminate the tightly bunched condition before additional envelopes are fed to the pickoff station. Because the motor shut off system is independent of the speed control system, the speed setting continues to decrease even while the motor is deactivated. Thus, if the drive motor is inactive for a relatively long time, it comes back on at a slow speed because the envelopes are tightly bunched and a slow speed is desirable in this situation. Conversely, the motor comes back on at a relatively high speed if it has been deactivated for only a short time because, in this situation, the envelopes are not bunched as tightly and there is no need for a slow motor speed.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figures 1, 4, 5, 6:
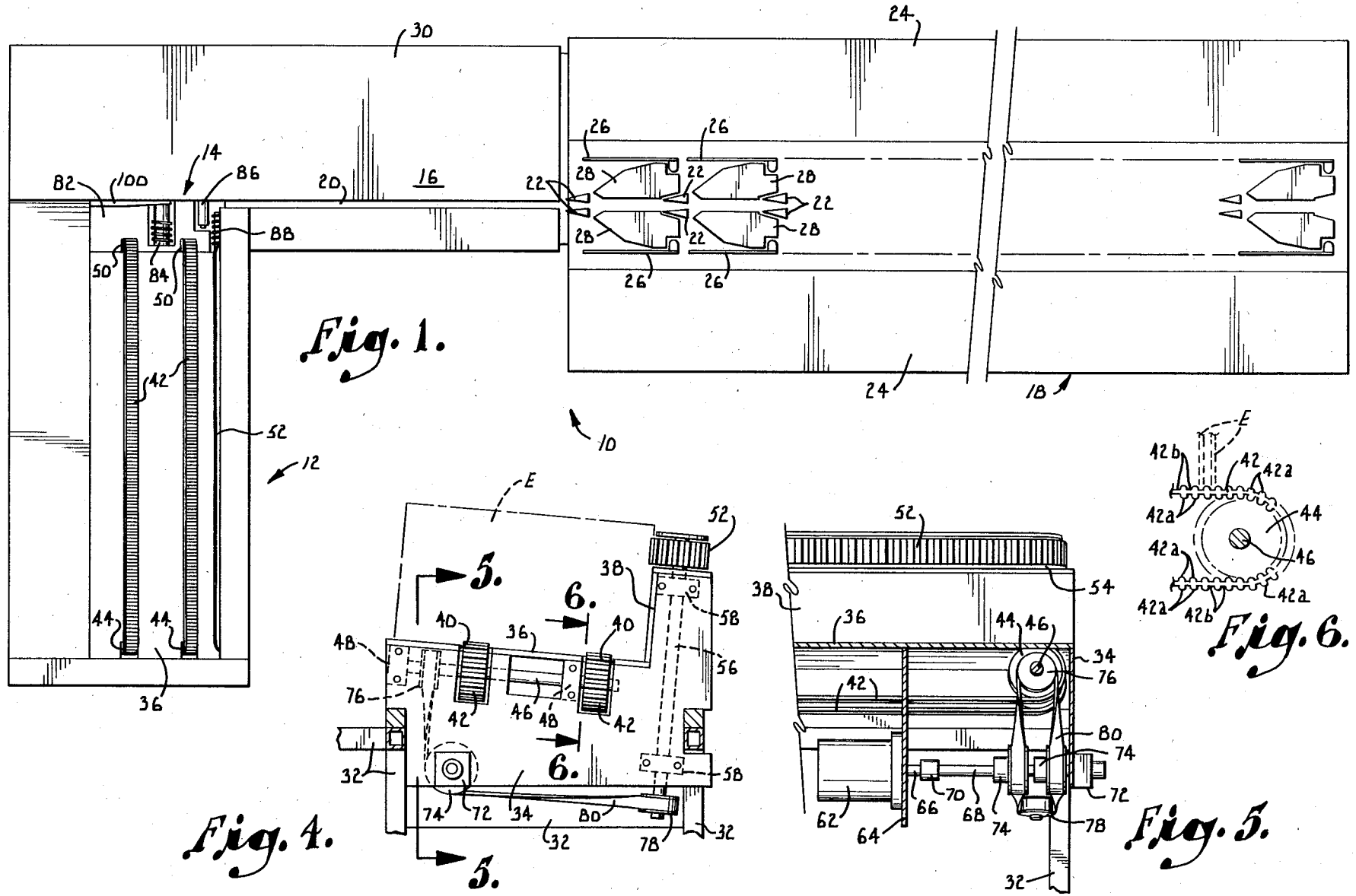
FIG. 1 is a top plan view of a mail sorting machine equipped with an envelope feeding mechanism and control system constructed according to a preferred embodiment of the present invention, with the break lines indicating continuous length of the storage section of the machine.
FIG. 4 is a fragmentary sectional view taken generally along line 4—4 of FIG. 2 in the direction of the arrows.
FIG. 5 is a fragmentary sectional view taken generally along line 5—5 of FIG. 4 in the direction of the arrows.
FIG. 6 is a fragmentary sectional view on an enlarged scale taken generally along line 6—6 of FIG. 4 in the direction of the arrows.

Referring now to the drawings in more detail and initially to FIG. 1, a high speed mail sorting machine is generally designated by reference numeral 10. The mail sorting machine 10 is of the same general type as that disclosed in U.S. Pat. No. 4,275,875, issued to Roy Akers on June 30, 1981, which application is incorporated herein by reference.

The main components of the mail sorting machine 10 are a magazine section 12 which receives the envelopes that are to be sorted, a pickoff station 14 at which the individual envelopes are separated one at a time from the supply of envelopes loaded on the magazine section 12, a read station 16 at which the zip code or other sorting code imprinted on each envelope is read, and a storage section 18 which receives and holds the sorted envelopes. The individual envelopes are separated from the envelope supply at the pickoff station 14 and are then delivered one at a time on edge past the read station 16 through a guide way 20 which terminates at the input end of the storage section 18. In the storage section of the machine, a plurality of sets of diverter gates 22 selectively deflect the sorted envelopes into storage areas 24 located on opposite sides of the storage section 18. The storage areas 24 can each be equipped with a plurality of separate storage bins (not shown), or the envelopes can be held in separate stacks by hinged plates 26 or other stacking devices. Guide plates 28 are located adjacent to each set of deflector gates 22.

The mail sorting machine 10 can be provided with a code reading device (not shown) located at the read station 16 beneath a cover panel 30. The code reading device can be an optical code reader or any other suitable type of device capable of reading the codes that are imprinted on the envelopes. Alternatively, a human operator can read the codes on the envelopes and manually enter the codes on a key board or the like. In any event, one of the deflector gates 22 is operated by electronic circuitry in order to deflect the envelope into the proper bin or other storage area which corresponds to the code imprinted on the envelope.

Figures 2, 3:
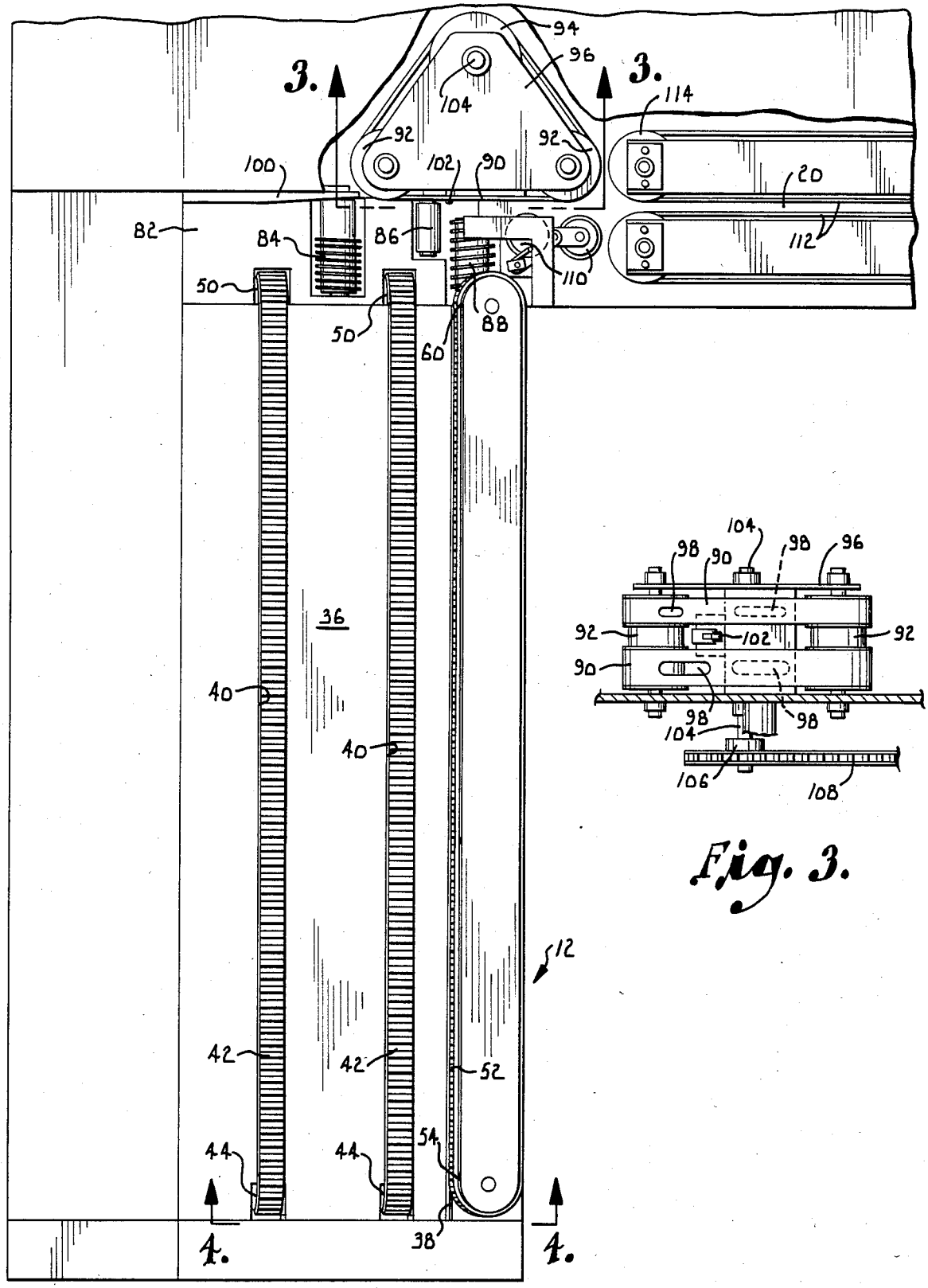
FIG. 2 is a fragmentary plan view on an enlarged scale showing the magazine section and pickoff station of the mail sorting machine, with portions broken away for purposes of illustration.
FIG. 3 is a fragmentary sectional view taken generally along line 3—3 of FIG. 2 in the direction of the arrows.

The present invention provides an improved envelope feeding mechanism for handling the envelopes in the magazine section 12, along with a control system for controlling the operation and speed of the feeding mechanism. With particular reference to FIGS. 2, 4 and 5, the magazine section 12 of the machine has a frame 32 on which a vertical end panel 34 is mounted at the input or upstream end of the magazine (the lower end as viewed in FIG. 2). An inclined conveyor surface is provided by a floor panel 36 which extends the entire length of the magazine 12 between the input end and the opposite or downstream end located adjacent the pickoff station 14.

As best shown in FIG. 4, panel 36 inclines downwardly from left to right at an angle of approximately 5° from horizontal Extending upwardly from the lower or right side of the floor panel 36 is a side panel 38 which likewise extends the entire length of the magazine 12. The side panel 38 is perpendicular to the floor panel 36 and is thus offset from vertical by about 5°. As shown in FIG. 4, the floor panel 36 provides a surface which receives the long lower edges of envelopes E which are deposited in the magazine, while the side edges of the envelopes engage the side panel 38. The incline of the floor panel 36 assures that the side edges of the envelopes E will remain against the side panel 38.

The inclined floor panel 36 is provided with a pair of parallel longitudinal slots 40 in which a pair of endless flexible belts 42 operate. The belts 42 are toothed belts which are drawn around sprockets 44 carried on a common shaft 46 at the input or upstream end of the magazine 12. The shaft 46 is supported for rotation by a pair of bearings 48 secured to the frame of the machine. The opposite or upstream ends of the belts are similarly drawn around sprockets 50 (FIGS. 1 and 2). The sprockets 44 and 50 locate the upper runs of the belts 42 slightly above the conveyor surface provided by the inclined floor panel 36.

As best shown in FIG. 6, each belt 42 is provided with a plurality of teeth **42*a* which project from both surfaces of the belt. The teeth 42*a* are equally spaced and extend transversely across the entire width of the belt. Between each pair of teeth 42*a*, a groove 42*b* is formed to also extend transversely across the width of the belt. The teeth 42*a* which project from the inside surfaces of the belt are engaged by the sprockets 44 and 50 so that the belts are driven by the sprockets. The grooves 42*b*** are wide enough to accommodate the edges of the envelope E.

A third toothed belt 52 is supported to travel generally along the top edge of the inclined side panel 38. Belt 52 is constructed in the same manner as belts 42 and is provided with teeth and grooves identical to teeth **42*a* and grooves 42*b*. The upstream end of belt 52 is drawn around a sprocket 54 which is carried on the top end of a shaft 56. The shaft 56 is inclined slightly from vertical and supported for rotation by a pair of bearings 58 secured to the frame of the machine. The opposite or downstream end of belt 52 is similarly drawn around another sprocket 60 (see FIG. 2). The sprockets 54 and 60 locate the forward run of belt 52 such that it projects slightly beyond the side panel 38**.

The belts 42 and 52 are driven by a multiple speed electric motor 62 which is secured to a mounting panel 64 on the frame of the machine. The motor 62 has an output shaft 66 which is coupled end to end with another shaft 68 by a coupling 70. The opposite end of shaft 68 is received by a bearing 72 mounted on the frame of the machine. Shaft 68 carries two pulleys 74. Additional pulleys 76 and 78 are mounted on shafts 46 and 56, respectively. A drive belt 80 is drawn around pulley 76 and is twisted and passed around both pulleys 74 before being twisted again and passed around pulley 78. Consequently, the operation of motor 62 drives belts 42 and 52 at the same speed and in the same direction from the upstream end of magazine 12 toward the downstream end.

The downstream or discharge ends of the belts 42 terminate at a horizontal panel 82 which receives the lower edges of the envelopes that are fed to the pickoff station 14 by the feeding mechanism. A groove roller 84 and a smaller smooth roller 86 project upwardly above panel 82. Another grooved roller 88 is located at the end of the side panel 38 and receives the side edges of the envelopes that are conveyed to the end of the side panel. Roller 88 is elevated with respect to the other rollers 84 and 86.

The envelope pickoff device located at the pickoff station 14 includes a pair of vacuum belts 90 each drawn around a pair of front rollers 92 and a single back roller 94. The front rollers 92 locate the front runs of the vacuum belts 90 perpendicular to the direction of movement of the envelopes along the magazine section 12 of the machine. A triangular plate 96 is located above the rollers. As described in the aforementioned Akers U.S. Pat. No. 4,275,875, the vacuum belts 90 have openings 98 (see FIG. 3) which communicate with a vacuum source in order to draw the flat front faces of the envelopes against the front surfaces of the vacuum belts. The grooved rollers 84 and 88 are driven by an appropriate drive system (not shown) in order to feed the envelopes to the vacuum belts 90. A tapered guide plate 100 helps to guide each envelope as it approaches the vacuum belts.

A switch 102 is located between the two vacuum belts 90, as best shown in FIG. 3. The switch 102 normally projects beyond the vacuum belts 90 such that it is depressed when an envelope is located at the pickoff station 14 (shown in FIG. 1) and drawn by vacuum against the belts 90. The switch 102 thus senses the presence or absence of an envelope at the pickoff station since it is depressed when there is an envelope present and is released when there is not an envelope present at the pickoff station.

As shown in FIG. 3, the vacuum belts 90 are driven by the drive roller 94 which is shown in FIG. 2 as mounted on a vertical shaft 104. The lower end of shaft 104 carries a sprocket 106 which receives a drive chain 108. The chain 108 is driven at a suitable speed to move belts 90 in the proper direction to convey the picked off envelopes one at a time into the guide way 20. Guide rollers 110 oppose the vacuum belts 90 to assist in guiding the individual envelopes into the guide way.

As shown in FIG. 2, a pair of belts 112 oppose one another on opposite sides of the guide way 20 in order to convey the individual envelopes from the pickoff station 14 to the first set of deflector gates 22 in the storage section 18 of the machine. Once the envelopes reach the storage section, they are conveyed in the manner shown in the aforementioned Akers U.S. Pat. No. 4,275,875 or in any other suitable manner. The belts 112 are drawn around rollers 114, and the rollers are driven at the proper speed by a suitable drive system (not shown).

Figure 7:
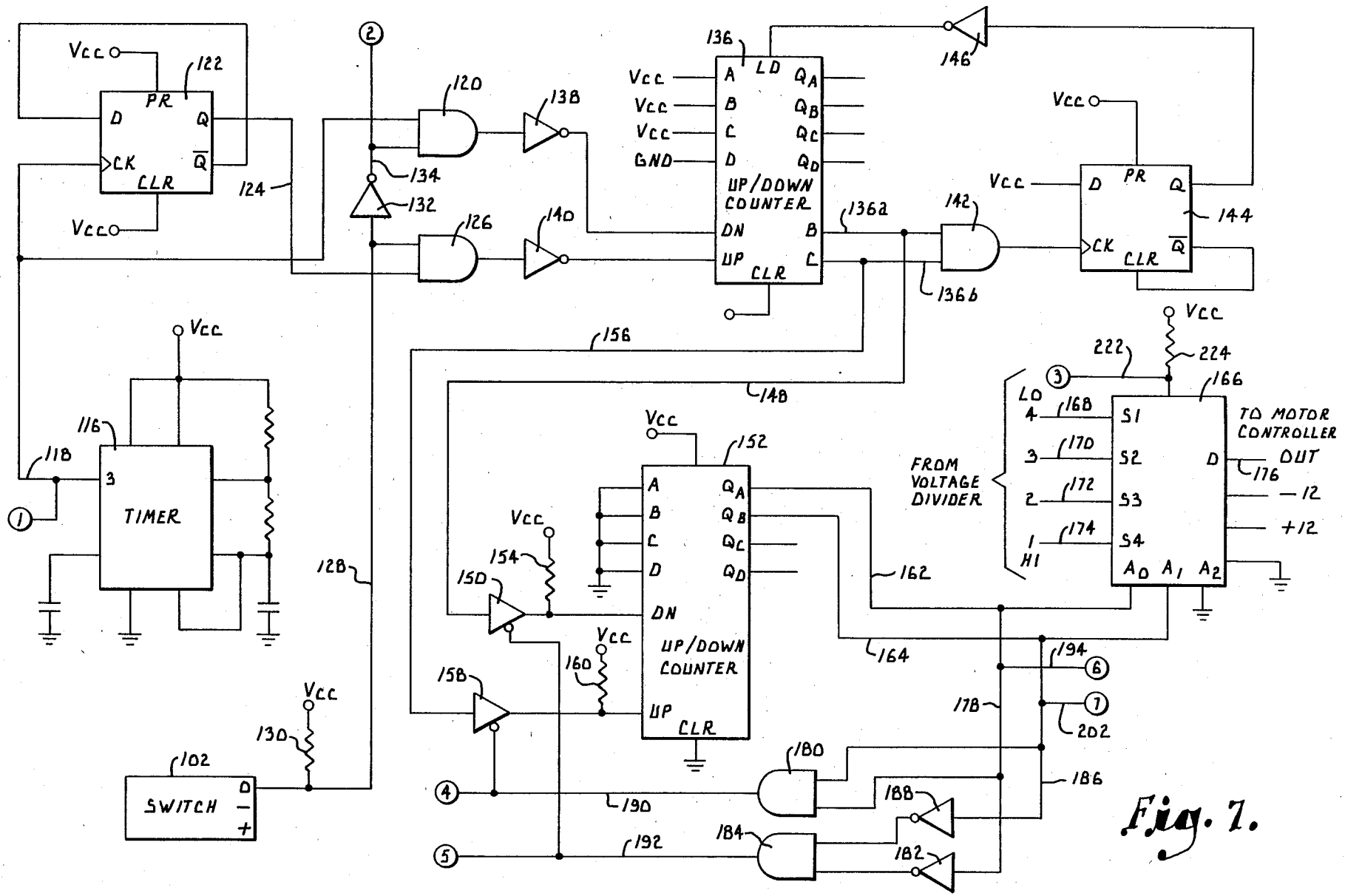
FIGS. 7 and 8 together provide a schematic diagram of the motor control circuitry which controls the drive motor of the envelope feeding mechanism.
Figure 8:
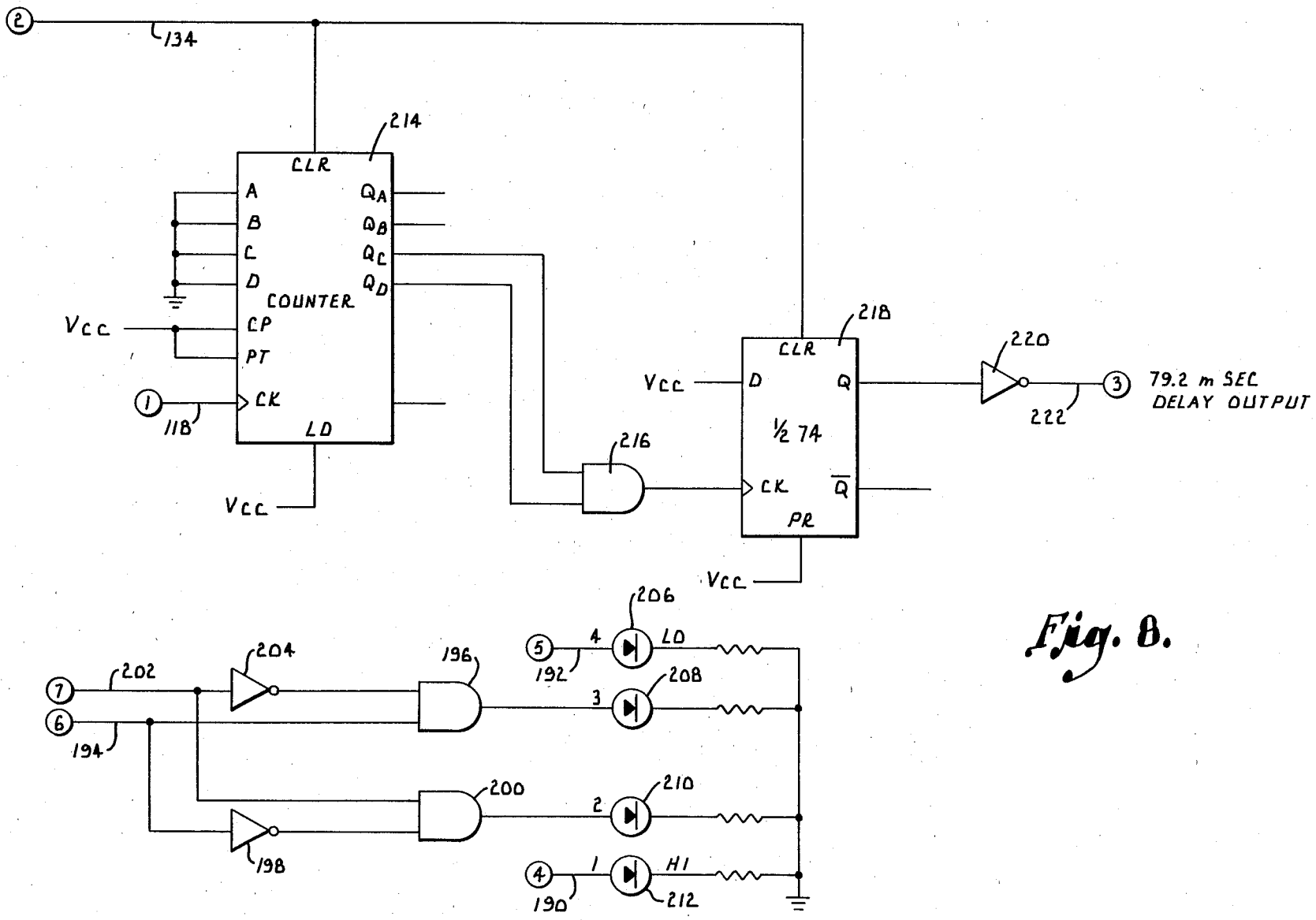

The operation and speed of the electric drive motor 62 are controlled by the electronic control system shown schematically in FIGS. 7 and 8. Referring first to FIG. 7, the control system includes a 555 timer circuit 116 having an output line 118 to which 6.6 millisecond square wave clock pulses are applied by the timer. Line 118 connects with an AND gate 120 and with the clock input to a flip-flop circuit 122 which functions as a divide by two counter. The Q output line 124 of flip-flop 122 receives 13.2 millisecond square wave clock pulses which are applied to another AND gate 126.

The switch 102 which senses the presence or absence of an envelope at the pickoff station 14 has an output line 128 which connects with a voltage source through a pull up resistor 130. The switch output line 128 is in a low condition when switch 102 is depressed by an envelope at the pickoff station. When there is no envelope at the pickoff station, the switch 102 is released and line 128 is pulled to a high state through the pull up resistor 130. The output line 128 of the switch connects directly with AND gate 126 and through inverter 132 with the other AND gate 120.

An up/down counter 136 has its "down" input connected with the output of gate 120 through an inverter 138. The output from the other AND gate 126 is connected through an inverter 140 with the "up" input of counter 136. An initial count state of seven (binary 0111) is preset on the counter 136. The B and C or borrow and carry outputs of the counter 136 are connected with respective lines **136*a* and 136*b* forming the inputs to an AND gate 142 having its output line connected with the clock input of a flip-flop 144. The Q output line of the flip-flop 144 is connected with an inverter 146 having its output side connected with the load terminal of the up/down counter 136. When a low signal is delivered to the load input of counter 136**, the preset count state of seven is loaded into the counter.

The B output line **136*a* of the up/down counter 136 connects via line 148 with the input side of a tri-state circuit 150. The output side of circuit 150 is connected with the down input of another up/down counter 152. Voltage is applied to the output line of circuit 150 through a pull-up resistor 154. Line 156 connects the C output line 136*b* of counter 136 with the input side of another tri-state circuit 158. The output side of circuit 158 is connected with the up input of counter 152. Voltage is applied to the output line of circuit 158 through a pull-up resistor 160. Counter 152** has an initial or preset count state of zero.

The binary coded QA and QB outputs of counter 152 are connected with respective output lines 162 and 164 which connect with the A0 and A1 address terminals of a data selector 166. The QC and QD outputs of counter 152 are not used. The third address line A2 of data selector 166 is connected with ground.

The data selector 166 has an S1 input line 168, an S2 input line 170, an S3 input line 172, and an S4 input line 174. A different voltage is applied to each of these lines. Preferably, the voltages that are applied to the input lines of the data selector are derived from the motor controller (not shown) for the electric drive motor 62. By using a suitable voltage divider in association with the motor controller, a selected minimum voltage can be applied to the S1 input line 168, and a selected maximum voltage can be applied to the S4 input line 174. Intermediate voltages can be applied to the S2 and S3 lines 170 and 172. It is preferred that the voltage increments between each successive line be the same so that the drive motor speed change is effected in equal increments. The data selector 166 has a D output line 176 which leads to the motor controller and which applies to the motor controller the voltage the selected input line, which depends upon the state of the address lines 162 and 164. The drive motor 62 increases in speed proportionally to the increasing voltage which is applied to the output line 176.

Line 162 connects via line 178 with an AND gate 180 and also with an inverter 182. The output side of inverter 182 connects with another AND gate 184. Line 186 connects the QB output line 164 with gate 180 and with an inverter 188 having its output side connected with the second input of the other AND gate 184.

Gate 180 has an output line 190 which controls tri-state circuit 158. The tri-state device is enabled when line 190 is a low state and is disabled when line 190 is in a high state. Similarly, the output line 192 of gate 184 is used to control the other tri-state circuit 150. Circuit 150 is enabled when line 192 is in a low state and is disabled when line 192 is in a high state.

Extending from line 178 is a conductor 194 which, as shown in FIG. 8, connects with an AND gate 196 and also with an inverter 198. The output side of the inverter 198 is connected to one input of another AND gate 200. Another conductor 202 connects with line 186 and leads to an inverter 204 and also to the other input of gate 200. The output from inverter 204 is the second input to gate 196.

With continued reference to FIG. 8, a visual display of the speed at which the drive motor 62 is operating is provided by four light emitting diodes. The first LED 206 connects on its anode side with the output line 192 from gate 184. The second and third LED's 208 and 210 connect with the output sides of the respective AND gates 196 and 200. The fourth LED 212 connects with line 190. The cathode sides of the LEDS are connected with ground through suitable resistors.

As previously described, the output line 118 of timer 116 receives 6.6 millisecond clock pulses. A counter 214 (FIG. 8) has its clock input connected with line 118 to receive the clock pulses emitted by the timer 116. The QA and QB output lines of counter 214 are not used. The QC and QD output lines are connected to the inputs of an AND gate 216. The output signal from gate 216 is applied to the clock input of a flip-flop 218 having its Q output line connected with an inverter 220. The inverter has an output line 222 which, as shown in FIG. 7, is used to enable and disable the data selector 166. When line 222 is in a high state, the data selector is disabled by the application of voltage through a resistor 224. The data selector is enabled when line 222 is in a low state.

The clear lines of counter 214 and flip-flop 218 are controlled by the output line 134 from inverter 132. The counter 214 and the flip-flop 218 are cleared when line 134 is placed in a high state due to depression of the switch 102 by an envelope located at the pickoff station 14 of the mail sorting machine.

In operation of the machine, the envelopes E that are to be sorted are loaded in a stack onto the floor panel 36 of the magazine section 12. The envelopes E are arranged side-to-side with each envelope occupying a vertical plane. The long lower edge of each envelope rests on the conveyor surface provided by the floor panel 36 and the belt 42. One side edge of each envelope rests against the side panel 38 and the elevated belt 52. The front faces of the envelopes face in a downstream direction.

The grooves **42*b* of the belts 42 are each wide enough to receive the lower edge of one envelope. Similarly, the side edge of each envelope is received in the groove formed between adjacent teeth of the elevated belt 52**. The grooves in the belts are aligned so that each envelope is oriented perpendicular to the direction it is moved by the envelope feeding mechanism.

The drive motor 62 operates to drive belts 42 and 52 at the same speed so that the envelope supply is conveyed toward the pickoff station 14. Because the belts move at the same speed, the grooves which receive each envelope remain in alignment so that the envelopes are not skewed or otherwise disoriented as they travel along the magazine section 12 of the machine. The elevated belt 52 helps to convey the envelopes and assures that each envelope remains in an upright posture at all times. The drive belts define a straight conveyor path between the input and discharge ends of the magazine 12.

When the leading envelope in the envelope supply reaches the pickoff station 14, it is discharged from belts 42 and 52 onto the panel 82 and the rollers 84 and 86. The side edge of each envelope is received in the grooves of the elevated roller 88. The grooved rollers 84 and 88 are driven to advance the envelope toward the vacuum belts 90 which pick the envelopes off one at a time from the envelope supply. The vacuum which is applied through the vacuum openings 98 in the vacuum belts draws the leading envelope firmly against the belts so that the envelopes are delivered one at a time into the guide channel 20 along which they are conveyed by belts 112. The code imprinted on the face of the envelope is read at the read station 16, and the deflector gate 22 corresponding to the code is deflected to divert the envelope into the appropriate storage bin or other storage area in the storage section 18 of the machine.

The speed at which the drive motor 62 drives belts 42 and 52 is determined by the binary coded signal applied to lines 162 and 164. For example, if both lines are in a low state, both the A0 and A1 address lines are in a low state and the data selector 166 selects the voltage on the S1 line 168. This minimum voltage level is applied to the D output line 176 and causes the motor 62 to operate at its minimum speed. If line 162 is high and line 164 is low, the binary 01 address is selected and output line 176 receives the voltage on the S2 input line 170 so that the motor runs at the next lowest speed. A high state on line 164 and a low state on line 162 results in application of the voltage on the S3 line 172 to the output line 176, thereby operating the motor at the next to the highest speed. Finally, if both lines 162 and 164 are high, the binary 11 address is selected and the maximum voltage on the S4 input line 174 is applied to line 176 to operate the drive motor at its maximum speed.

When counter 152 is in the zero count state, both lines 162 and 164 are low and gate 184 then applies a high signal on its output line 192. This high signal disables the tri-state circuit 150 and prevents counter 152 from being decremented. Similarly, when counter 152 reaches its maximum count state (binary 11), both lines 162 and 164 are high, and gate 180 applies a high signal on its output line 190. This disables tri-state device 158 and prevents counter 152 from being incremented. In this manner, the logic gates 180 and 184 and tri-state circuits 150 and 158 prevent counter 152 from being decremented below its minimum count state of zero or incremented above its maximum count state of binary 11.

The LED display provides a visual display of the speed at which the motor operates. When lines 162 and 164 are both low indicating the low speed of the motor, line 192 is in a high state to energize the first LED 206 which corresponds to the low motor speed. The other LEDs are off when line 162 is high and line 164 is low, line 194 is high and line 202 is low, thereby activating gate 196 and energizing LED 208 to indicate that the motor is operating at its second lowest speed. When line 162 is low and line 164 is high, line 202 is high and line 194 is low so that gate 200 is activated to energize LED 210, indicating that the motor is operating at its second highest speed. Finally, when lines 162 and 164 are both high, line 190 energizes LED 212 to indicate that the motor is operating at its highest speed level. The logic circuitry prevents more than one LED to be energized at any one time.

The operation and speed of the drive motor 62 are controlled by the control circuitry shown in FIGS. 7 and 8. When an envelope is present at the pickoff station 148, it depresses switch 102 and thereby places line 128 in a low state. Since one input to gate 126 is low, the clock pulses applied to line 124 have no effect and a high signal is applied to the up input of the up/down counter 136.

However, line 134 is in a high state and the output of gate 120 cycles high and low in response to the 6.6 millisecond clock pulses present on line 118. Each clock pulse which reaches the down input of counter 136 decrements the count state from the preset count state of seven. If switch 102 remains depressed long enough for the count to be decremented to zero (46.2 milliseconds), the B or borrow output line **136*a* of counter 136 is activated and a signal is applied to the down input of counter 152 through line 148 and tri-state circuit 150. The down signal decrements the count state of counter 152 and changes the binary coded signal applied to the QA and QB output lines 162 and 164**.

Thus, each time the switch 102 remains depressed for 46.2 milliseconds, the count state of counter 136 is reduced to zero and the count state of counter 152 is decremented. This in turn decrements the address signal applied to data selector 166 and causes the drive motor 62 to slow down to the next lower speed so that the feeding mechanism delivers the envelopes to the pickoff station 14 at a slower rate. So long as switch 102 remains depressed, the circuitry continues to decrement the motor speed until the minimum speed setting is reached, at which time tri-state circuit 150 is disabled to prevent counter 152 from being further decremented.

When there is not an envelope present at the pickoff station 14, switch 102 is released and line 128 is pulled to the high state through resistor 130. Gate 120 then receives a low input through inverter 132 so that the down input of counter 136 is not affected by the clock pulses on line 118. However, gate 126 receives a high signal on one input, and its other input is cycled by the 13.2 millisecond clock pulses that are present on line 124. Each clock pulse which reaches the up input of counter 136 increments the count state. When the maximum count state of 16 (binary 1111) is reached, the C output line **136*b* of counter 136 is activated to signal the up input of counter 152 through line 156 and tri-state circuit 158. Counter 152 is thus incremented to increment the binary coded address signal which is applied to the data selector 166. The drive motor 62 is then incremented by one discrete speed level. So long as the switch 102 is not depressed, the drive motor speed continues to increment until the highest speed level is reached, at which time tri-state circuit 158 is disabled to prevent counter 152** from being further incremented.

Counter 136 is reset to its initial count state of seven each time either its B output line **136*a* or C output line 136 is activated. As previously indicated, a high signal is applied to either the up or down input to counter 136 at all times, and either line 136*a* or 136*b* is high as a consequence. When counter 136 is decremented to 0 or incremented to sixteen, the other line 136*a* or 136*b* goes high to activate gate 142. The clock signal to flip flop 144 causes the Q output line of the flip flop to go high, and inverter 146 applies a low signal to the load terminal of counter 136**. This causes the counter to revert to its present count state.

In this manner, the speed at which envelopes are fed to the pickoff station 14 is controlled in accordance with the state of switch 102. If the switch is depressed long enough to indicate that the envelopes are bunched together too tightly, the drive motor speeed is decremented by discrete levels and at regular intervals. Conversely, if switch 102 remains in the released condition long enough to indicate that the envelopes are not being fed to the pickoff station fast enough, the drive motor speed is incremented at regular intervals by discrete speed levels. It should be noted that if the switch 102 is depressed and released in a pattern indicating that the envelopes are arranged neither too tightly nor too loosely, the count state of the up/down counter 136 will remain between zero and sixteen, and the speed setting of the motor will not change.

It is an important feature of the invention that the motor speed is decremented at more frequent intervals than it is incremented because it is more important to prevent the envelopes from bunching together too tightly than it is to cure an unduly loose condition of the envelopes. The down input to counter 136 is controlled by the 6.6 millisecond clock pulses that are applied to line 118, while the up input to the counter is controlled by the 13.2 millisecond pulses that are applied to line 124. In addition, counter 136 has a preset count state of seven which is closer to the minimum count state of zero than it is to the maximum count state of sixteen. As a consequence, the drive motor is decremented by one speed level each time switch 102 remains depressed for 46.2 milliseconds. However, switch 102 must be released for 118.8 milliseconds before the drive motor is incremented to its next higher speed setting.

The control circuitry also acts to shut down the drive motor in the event that its speed is decremented by one speed setting and the envelopes still remain bunched too tightly together. When switch 102 is depressed, the high signal on line 134 is applied to the clear terminals of counter 214 and flip-flop 218. Counter 214 then begins to count the 6.6 millisecond clock pulses which are applied on line 118 to its clock input. When the count state of counter 214 reaches twelve (binary 1100), indicating that switch 102 has been depressed continuously for 79.2 milliseconds, the QC and QD output lines of counter 214 are both placed in a high condition to activate gate 216. The gate then applies a signal to the clock input of flip-flop 218, and line 222 receives a signal through inverter 220 to disable the data selector 166. In the disabled condition of the data selector, the output line 176 is deactivated to deactivate the drive motor 62 of the envelope feeding mechanism.

The drive motor is thus disabled only if switch 102 remains depressed continuously for 79.2 milliseconds. Since the drive motor is decremented by one speed setting each time switch 102 remains depressed for 46.2 milliseconds, the motor will be deactivated only if the tightly bunched condition of the envelopes remains for another 33.4 milliseconds after the motor speed has been decremented by one speed level. This gives the speed control system sufficient time to relieve the tightly bunched condition of the envelopes, and if it is not able to do so, the motor is deactivated. If switch 102 is released before 79.6 milliseconds have elapsed, counter 214 is cleared along with flip-flop 218 so that the 79.2 millisecond shut off time interval is again initiated.

It is important to recognize that the speed control circuitry is independent of the motor shut off circuitry. Consequently, the speed setting of the drive motor continues to be decremented even while the drive motor is shut off. Thus, if the drive motor is off for a relatively long time, indicating that the envelopes are very tightly bunched, the speed setting of the drive motor will be decremented to its lowest level since the counters 136 and 152 continue to operate whether or not the drive motor is activated. When switch 102 is finally released, the drive motor 62 is activated and comes on at its lowest speed setting to prevent the envelopes from being tightly bunched against the pickoff station 14. Conversely, if the motor remains off for only a short time period, indicating that the envelopes are not unduly bunched together, the motor will come back on at approximately the same speed as it was operating when it was deactivated, or at the next lower speed level.

It is thus apparent that the present invention provides an improved feeding mechanism for feeding the envelope supply to the pickoff station 14 of the mail sorting machine. The drive belts 42 which underlie the envelope supply, along with the elevated belt 52 which controls the side edges of the envelopes, are able to maintain the envelopes in the proper upright posture and orientation as they approach the vacuum belts 90. Consequently, the feeding mechanism is less prone to double envelope picking and other mispicking problems than some of the other feeding mechanisms that have been proposed in the past.

The circuitry which controls the speed and operation of the drive motor 62 automatically maintains the envelopes in a condition in which they are bunched together neither too tightly nor too loosely. The automatic manner in which the speed control and motor shutoff systems operate eliminates human error and does not require the constant attention of a human operator to function properly. The speed settings at which motor 62 drives the feeder belts 42 and 52 are separated by discrete levels and may differ from the four speed settings disclosed herein.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. In a mail sorting machine having a magazine section for receiving a supply of envelopes to be sorted, pickoff means for picking off the envelopes one at a time from the envelope supply, multiple speed feeding means for feeding the envelope supply in said magazine section to said pickoff means, and means for sorting and depositing the envelopes in a storage area of the machine, the improvement comprising:

means for sensing the presence or absence of an envelope at a pickoff station adjacent the pickoff means;

means for automatically decreasing the speed of the feeding means when an envelope is present at said pickoff station for a first predetermined time period selected as being indicative of undue bunching of the envelopes in the magazine section of the machine; and means for automatically increasing the speed of the feeding means when an envelope is absent from said pickoff station for a second predetermined time period selected as being indicative of undue looseness of the envelopes in the magazine section of the machine.

2. The invention of claim 1, wherein said second time period is greater than said first time period.

3. The invention of claim 1, including means for deactivating the feeding means to stop the movement of the envelope supply in the magazine section of the machine when an envelope is present at said pickoff station for a third predetermined time period.

4. The invention of claim 3, wherein said third time period is greater than said first time period.

5. Envelope feeding apparatus for a mail sorting machine having a magazine section for receiving a supply of envelopes to be sorted, means for picking off the envelopes one at a time from the envelope supply at a pickoff station, and means for sorting and depositing the envelopes in a storage area of the machine, said envelope feeding apparatus comprising:

feeding means for feeding the envelope supply in the magazine section to the pickoff station;

multiple speed drive means for driving said feeding means, said drive means having active and inactive states and a plurality of discrete speed settings for driving said feeding means at a plurality of discrete speeds when said drive means is in the active state;

switch means engageable by envelopes at the pickoff station, said switch means having a first condition when an envelope is present at the pickoff station and a second condition when an envelope is not present at the pickoff station;

means for decrementing said drive means from one speed setting to the next lower speed setting each time said switch means has been in the first condition for a first predetermined time period; and means for incrementing said drive means from one speed setting to the next higher speed setting each time said switch means has been in the second condition for a second predetermined time period.

6. The invention of claim 5, wherein said first time period is less than said second time period.

7. The invention of claim 5, including means for effecting the inactive state of said drive means each time said switch means has been in the first condition for a third predetermined time period greater than said first time period.

8. The invention of claim 7, wherein said decrementing means and said incrementing means are operable to change the speed setting of said drive means in both the active and inactive states of said drive means.

9. The invention of claim 5, wherein said discrete speed settings include a minimum speed setting and a maximum speed setting, and including:

means for disabling said decrementing means when said drive means is in the minimum speed setting; and means for disabling said incrementing means when said drive means is in the maximum speed setting.

10. The invention of claim 5, including means for displaying the speed setting of said drive means.

11. In a mail sorting machine having a magazine section for receiving a supply of envelopes to be sorted, pickoff means for picking off the envelopes one at a time from the envelope supply at a pickoff station, feeding means for feeding the envelope supply in the magazine section to the pickoff station, and means for sorting and depositing the envelopes in a storage area of the machine, the improvement comprising:

drive means for driving said feeding means, said drive means having active and inactive states and a plurality of discrete speed settings for driving said feeding means at a plurality of discrete speeds in the active condition of said drive means;

a switch at the pickoff station engaged by an envelope present at the pickoff station to effect a first condition of the switch, said switch having a second condition when an envelope is not present at the pickoff station to engage the switch;

counter means operable to count down toward a minimum count state when said switch is in the first condition and to count up toward a maximum count state when said switch is in the second condition;

means for decrementing said drive means to the next lower speed setting each time said minimum count state is reached;

means for incrementing said drive means to the next higher speed setting each time said maximum count state is reached;

means for resetting said counter means to an initial count state between the minimum and maximum count states each time said drive means is incremented or decremented; and means independent of said counter means for effecting the inactive state of said drive means when said switch has been continously in the first condition for a predetermined time period.

12. The improvement of claim 11, wherein said counter means counts down toward the minimum count state at a faster rate than it counts up toward the maximum count state.

13. The improvement of claim 11, wherein said discrete speed settings of said drive means include minimum and maximum speed settings and including:

means for disabling said decrementing means when said drive means is in the minimum speed setting; and means for disabling said incrementing means when said drive means is in the maximum speed setting.

14. The improvement of claim 11, including means for displaying the speed setting of said drive means.

15. An envelope feeding mechanism for feeding envelopes to an envelope pickoff device in a mail sorting machine, said mechanism comprising:

a conveyor surface defining a generally straight conveyor path having an input end and a discharge end located adjacent the pickoff device, said conveyor surface being inclined from side to side and being adapted to receive a supply of envelopes with the envelopes arranged side to side and each envelope having a lower edge thereof on the conveyor surface and oriented transversely to said conveyor path;

first and second toothed belts supported on the machine for movement generally along said conveyor path from the input end to the discharge end thereof to deliver the envelopes in the envelope supply to the pickoff device one at a time, each belt having a plurality of teeth between which grooves are presented for receiving the lower edges of the envelopes;

a side panel projecting upwardly from a low side of said conveyor surface, said side panel being inclined from vertical and oriented substantially perpendicular to said conveyor surface to receive side edges of the envelopes that are being conveyed on the conveyor surface;

a third toothed belt supported on the machine for movement generally along said side panel at an elevated position relative to said first and second belts, said third belt having a plurality of teeth between which grooves are presented for receiving the side edges of the envelopes to maintain the envelopes generally upright and to assist in conveying the envelopes along said conveyor path; and drive means for driving all of said belts at substantially the same speed, whereby the envelopes are maintained generally upright with the lower edges thereof remaining transverse to the conveyor path as the envelopes travel along said path.

16. The invention of claim 15, including:

a multiple speed drive motor coupled with said belts to provide said drive means, said motor having active and inactive states and a plurality of discrete speed settings for driving said belts at a plurality of different speeds in the active state of the motor;

means for sensing the presence of absence of an envelope at a pickoff device, said sensing means having a first condition when an envelope is present at the pickoff station and a second condition when an envelope is not present at the pickoff station;

means for decrementing said motor to the next lower speed setting thereof when said sensing means is in the first condition for a first predetermined time period; and means for incrementing said motor to the next higher speed setting thereof when said sensing means is in the second condition for a second predetermined time period.

17. The invention of claim 16, including means for effecting the inactive state of said motor when said sensing means is in the first condition for a third predetermined time period greater than said first time period.

18. The invention of claim 16, wherein said second time period is greater than said first period.

19. The invention of claim 16, wherein said decrementing means and said incrementing means are operable to change the speed setting of said motor in both the active and inactive states of the motor.

20. The invention of claim 16, wherein said discrete speed settings of the motor include a minimum speed setting and a maximum speed setting and including:

means for disabling said decrementing means when said motor is in the minimum speed setting; and means for disabling said incrementing means when said motor is in the maximum speed setting.

21. A method of feeding envelopes to an envelope pickoff station in a mail sorting machine, said method comprising the steps of:

arranging a plurality of envelopes side to side on a movable conveyor with each envelope occupying a substantially vertical plane;

driving the conveyor toward the pickoff station to deliver the envelopes thereof;

sensing whether or not an envelope is present at the pickoff station;

decreasing the speed at which the conveyor is driven when an envelope is present at the pickoff station for a first predetermined time period selected as being indicative of undue bunching of the envelopes on the conveyor; and increasing the speed at which the conveyor is driven when an envelope is not present at the pickoff station for a second predetermined time period selected as being indicative of undue looseness of the envelopes on the conveyor.

22. The method of claim 21, wherein said second time period is greater than said first time period.

23. The method of claim 21, including the step of stopping the conveyor when an envelope is present at the pickoff station for a third predetermined time period greater than said first period.

24. The method of claim 21, wherein the conveyor has a plurality of discrete speeds at which it is driven and the speed of the conveyor is decreased and increased by discrete levels.

25. The method of claim 24, wherein the discrete speeds of the conveyor include a minimum speed and a maximum speed, said method including the steps of:

preventing additional decrease in the speed of the conveyor when the conveyor is being driven at said minimum speed; and preventing additional increase in the speed of the conveyor when the conveyor is being driven at said maximum speed.

26. The method of claim 24, wherein:

said decreasing step includes counting down toward a minimum count state when an envelope is present at the pickoff station and decrementing the speed of the conveyor to the next lower speed when the minimum count state is reached; and said increasing step includes counting up toward a maximum count sate when an envelope is not present at the pickoff station and incrementing the speed of the conveyor to the next higher speed when the maximum count state is reached.

27. The method of claim 26, including the step of stopping the conveyor when an envelope is present at the pickoff station for a third predetermined time period greater than said first time period, said stopping step being carried out independently of said steps of counting up and counting down.

* * * * *